US006086449A

United States Patent [19]

Sharp

[11] Patent Number: 6,086,449

[45] Date of Patent: Jul. 11, 2000

[54] CASCADING RELEASE FASTENER MECHANISM

[76] Inventor: David F. Sharp, Twin Rivers Apartments, 611 Abbington Dr. #A27, East Windsor, N.J. 08520

[21] Appl. No.: 09/231,701

[22] Filed: Jan. 14, 1999

Related U.S. Application Data

[60] Provisional application No. 60/071,363, Jan. 15, 1998.

[51] Int. Cl.[7] ..... A63H 33/00

[52] U.S. Cl. ..... 446/486; 446/4; 446/308; 446/429

[58] Field of Search ..... 446/2–4, 6, 85, 446/308, 311, 399, 429, 430, 435, 486

[56] References Cited

U.S. PATENT DOCUMENTS 2,517,084 8/1950 Carver .

5,380,231 1/1995 Grovelli ..... 446/6

5,727,947 3/1998 Esterle ..... 434/258

5,964,639 10/1999 Maxim ..... 446/437

*Primary Examiner*—Robert A. Hafer

*Assistant Examiner*—Laura Fossum

[57] ABSTRACT

A spring biased projectable latch mechanism having a triggerable release mechanism at the end of said latch which is projected furthest into a latch receptacle during fastener engagement. A latch housing part of an object being fastened, said housing comprising said latch, said spring bias means, at least one receptacle, and a trigger chamber area. The housing and latch mechanism are constructed such that the spring biased release of the latch of one object actuates the trigger release mechanism of each adjacent object, resulting in a cascading release of a complex structure of interconnected objects in response to a single latch release trigger event.

20 Claims, 13 Drawing Sheets

CASCADING RELEASE FASTENER MECHANISM

This application claims benefit of U.S. Provisional application 60/071,363 filed Jan. 15, 1998.

BACKGROUND

Field of Invention

This invention relates to remotely-triggered quick-release latch mechanisms, for fastening two or more components together in a sturdy yet releasable manner, specifically to such mechanisms that provide a cascading-release capability which allows an entire multi-component structure to be quickly disassembled with a single trigger event.

Description of Prior Art

There are many cases where it is desirable that two or more components be connected together in a releasable fashion, with commonly recognized applications including toy construction kits, strap connectors, emergency escape hatches, and automotive equipment.

In numerous common applications, such as with automotive trailer hitches, aircraft doors, and space-craft hatches, it is necessary to connect a single primary component to a single secondary component in a manner which is durable, yet releasable. Many such applications would benefit from the use of such a latch mechanism which offers a durable, inter-component fastening capability that combines a remote release trigger capability, a very low friction release, and spring driven retraction of the latch from the latch engagement receptacle. The prior art offers no combination of the durable protruding latch combined with a low-friction latch retraction means. The prior art also offers no combination of projecting latch fasteners combining low-friction and spring biased latch retraction. Furthermore, the prior art fails to anticipate a latch having a release trigger mechanism that is suitable for latching numerous components to one another to form complex three-dimensional structures, while allowing a single trigger event to cause each releasing latch to trigger the release of its neighboring latches, resulting in a cascading-release affect.

U.S. Pat. No. 4,420,860, to Chamuel, discloses a quick-release latch mechanism that provides a durable locking mode and a quick-release means. A disadvantage of that invention, however, is that during the release process as the latch pin is withdrawn from the receptacle, the friction of the locking ring against the receptacle wall must be overcome. Use of such latch mechanisms in harsh environments where foreign particles or corrosion are prevalent can result in a deterioration of locking mode reliability and an undesirable increase in latch mechanism withdrawal friction. Including, in extreme cases, situations when the latch fails to release. Furthermore, the cited invention fails to anticipate the desirability of providing a spring-biased means for rapid withdrawal of the latch mechanism from the latch receptacle.

U.S. Pat. No. 3,386,758, to Swearingen, discloses an aircraft latch assembly which also provides a durable locking mode and a quick release means. This design fails to provide a low-friction retraction of the latch mechanism and fails to anticipate the desirability of using a spring-bias means for rapid withdrawal of the latch mechanism from the latch receptacle.

It is common in the prior art to see projecting latches in which the prongs of the latch are normally biased towards the engaged position, but which are temporarily biased slightly inwards during the engagement process. For such latches, however, the outward bias of the prongs results in friction between the prongs and the engagement receptacle during the disengagement process as well, which can be undesirable for many applications. For example, U.S. Pat. No. 5,084,946, to David J. Lee, discloses a fastener in which a projected latch is inserted into an appropriate engagement receptacle. The disadvantage of this class of latches is that the normally-engaged bias of the latch prongs results in friction between the latch prongs and the latch receptacle during disengagement. Frequently, such latches become increasingly difficult to disengage over time as foreign matter accumulate in the receptacle.

Children's construction toys based on the insertion of a projecting member into a receptacle member are extremely common. U.S. Pat. No. 2,885,822, to Onanian, is merely one example. Such construction toys allow the child to construct complex three-dimensional structures, but require manual disassembly. A novel means for rapidly disassembling such construction toy assemblies after play is needed. A rapid disassembly means would provide both enhanced play value, and more convenient clean-up U.S. Pat. No. 4,979,926, to Bisceglia, discloses an exploding toy bridge invention which offers the exciting play value suggested by the current invention. This bridge invention, however, has several disadvantages. A major disadvantage is that the construction toy can only be used to make a bridge, a more robust exploding construction toy is needed to foster creativity in the child and to enhance play value. Additionally, the assembled bridge cannot be handled as a cohesive structure after assembly without disrupting the integrity of the structure. If the bridge structure is turned upside-down, for instance, the roadway surface and guard-rail items will simply fall off. A more durable exploding construction toy is needed, in which complex multi-element structures can be handled as sturdy cohesive units. U.S. Pat. No. 4,895,548, to Holland et al., discloses a similar toy construction set having disadvantages very similar to the disclosure by Bisceglia.

U.S. Pat. No. 5,322,466, to Bolli et al., discloses a detachable connecting device for toy construction elements. This invention discloses multiple latch prongs surrounding a locking pin cavity, in which the application of a rotational force to the locking pin results in the radial expansion of the prongs to establish the latch engagement state. The disadvantage of this latch mechanism, however, is that the latch must be disengaged from the same end at which it was engaged. A latch in which the disengagement occurs at the end opposite from the end providing the engagement means is needed. A further disadvantage of the referenced invention is that considerable friction may be realized between the latch shaft and the engagement receptacle during the disengagement process. This excessive friction is undesirable for many applications.

SUMMARY OF THE INVENTION

An invention is needed which combines the concepts of durably fastenable, remotely-releasable latch mechanisms with spring-biased latch retraction means and very-low-friction latch retraction paths. Such a combination is very useful for numerous safety-related applications such as emergency escape hatches, and is also extremely useful for implementation of the highly desirable cascading-release latch mechanism of the present invention.

The present invention provides a novel latch mechanism for fastening numerous objects together to form large complex three-dimensional structures. The latch mechanism is constructed as a member of a host object which is intended to be interconnected in a secure yet releasable manner to other host objects housing the same invention. Each object using the invention is capable of being securely fastened to another object by having its projectable latch mechanism inserted and engaged into a receptacle on another object. The invention includes features and characteristics that cause the release of the inventive latch mechanism associated with each host object to effect the release of all latch mechanism fastened to the engagement receptacles on that host object. The resulting release of the latch mechanisms within each of those attached secondary host objects similarly triggers the release of any latch mechanisms housed in tertiary host objects that happen to be fastened to the engagement receptacles on those secondary host objects. After creating a complex structure using a multitude of construction element objects each containing the latch mechanism of the current invention, a cascading-release of latches within the structure can be initiated by simply releasing the first latch. The result of the cascading-release of the latch mechanisms that interconnect the elements of the structure is that the structure will appear to disintegrate rapidly and crumble to the floor.

OBJECTS AND ADVANTAGES

An object of the invention is to provide an improved latch mechanism that introduces a novel latch release concept herein referred to as cascading-release. A cascading-release fastener mechanism offers the advantage of allowing a complex, three-dimensional structure to be constructed using a plurality of objects comprising the inventive latch mechanism, with the novel characteristic that the entire structure can be rapidly disassembled with the push of a single button.

An additional object of the invention is to provide such capabilities in a manner which allows said complex structure to be handled as a cohesive unit, requiring that the fastener mechanism be durable and sturdy.

A further object of the invention is to provide an improved projecting latch mechanism which overcomes the disadvantages of the prior art by combining a sturdy fastening mechanism, a remotely-triggered latch release for this fastening mechanism, and a spring-biased very-low-friction latch retraction during disengagement.

Other objects of the present invention are to provide a child's toy construction set in which large complex structures can be built using a multitude of similar or dissimilar construction elements having the features of the present invention, providing secure, positive locking means within the latches to prevent inadvertant disassembly of the complex structure during rough handling generally associated with child's play, providing the child with an exciting and dramatic demolition effect when the cascading release feature is initiated, and providing the child's parent with a prompt means of disassembling the play structure for convenient storage after the child finishes playing with the construction set.

The various features of novelty which characterize this invention are elaborated in the claims annexed to and forming a part of this disclosure. To provide a better understanding of the current invention, its operational advantages, and the objects attained by its several uses, reference is made to the accompanying drawings and specification materials in which the preferred embodiment of the invention is presented in the form of a child's toy construction set. The selection of a child's toy construction set as the preferred embodiment should not be construed as to limit the broad applicability of this novel invention.

SUMMARY OF REFERENCE NUMERALS

Figure 1:
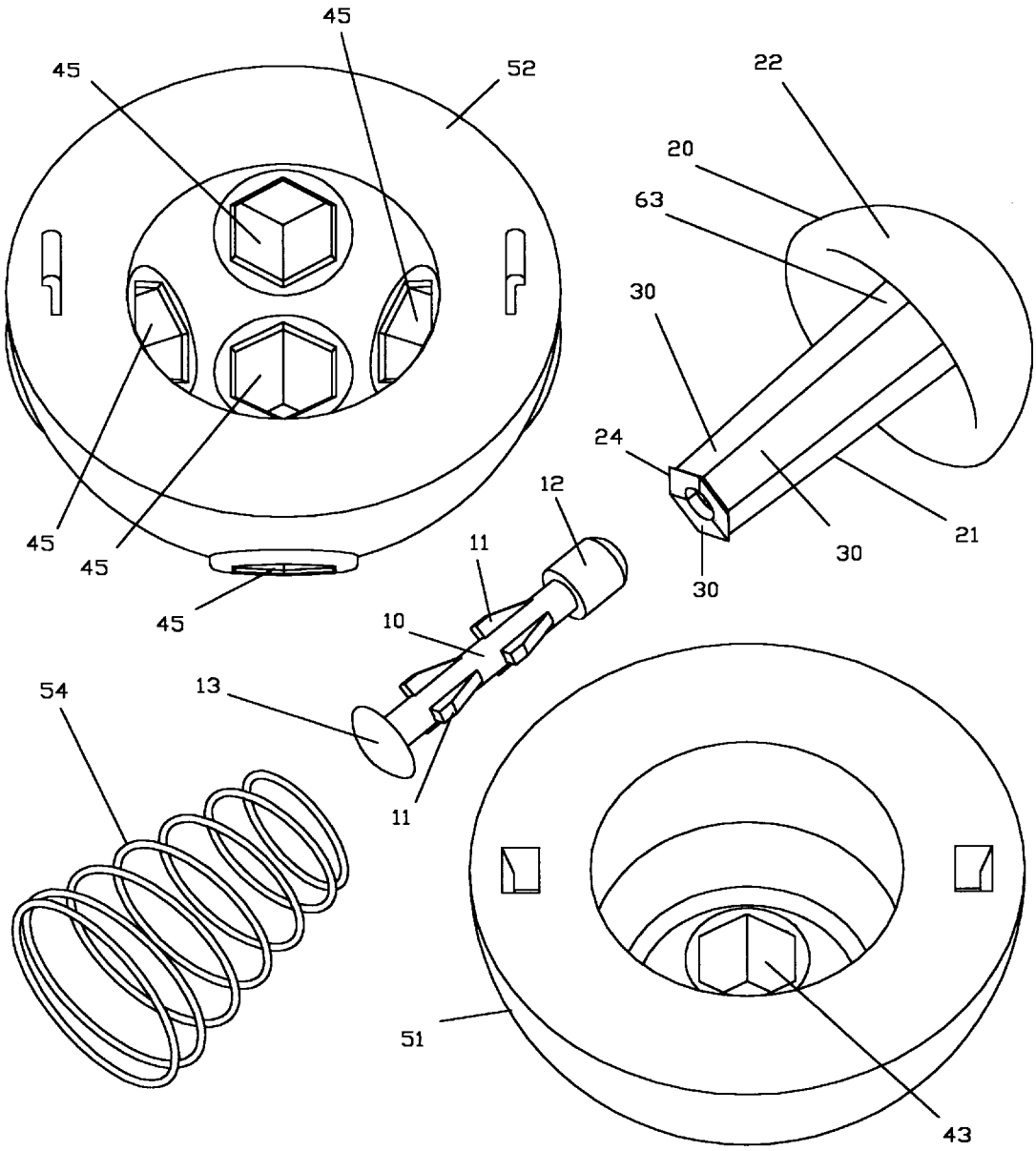
FIG. 1 is a perspective view of the five major components of the preferred embodiment.

The reference numerals used in the drawings and referenced in the specification are listed below for convenience.

| | |
|---|---|
| | Locking Pin Parts |
| 10 | locking pin |
| 11 | locking pin finger |
| 12 | locking pin inner head |
| 13 | locking pin outer head |
| 15 | locking pin shaft |
| 16 | locking-tool slot |
| | Latch Parts |
| 20 | latch mechanism |
| 21 | latch shaft |
| 22 | latch head |
| 23 | engagement tool insertion hole |
| 24 | latch engagement flange |
| 25 | latch head spring stop |
| 26 | locking pin cavity |
| 27 | inner pin head cavity |
| 28 | latch head hole bevel |
| | Latch Prong Inner-Surface Parts |
| 30 | latch prong |
| 31 | prong expansion cam |
| 32 | prong expansion ramp |
| 33 | prong engagement trough |
| 34 | prong release ramp |
| 35 | rotation barrier |
| 36 | rotation barrier shoulder |
| 37 | locking pin shaft guide |
| 38 | inner prong expansion cam |
| 39 | outer prong expansion cam |
| | Latch Housing Parts |
| 40 | latch housing cavity |
| 41 | spring compression area |
| 42 | latch housing spring stop |
| 43 | latch projection guide |
| 44 | latch trigger chamber |
| 45 | latch engagement receptacle |
| 46 | latch receptacle flange |
| | Object Parts and Misc. Parts |
| 50 | primary object |
| 51 | bottom hemisphere of primary object |
| 52 | top hemisphere of primary object |
| 53 | starter block |
| 54 | spring |
| 55 | bottom hemisphere of secondary object(s) |
| | Regions and Zones of the Latch Prongs |
| 62 | pin release zone |
| 63 | latch prong stress zone |
| 65 | rotation barrier region |
| 66 | expansion cam region |
| 67 | float zone region |

DETAILED DESCRIPTION OF THE PREFERRED EMBODIMENT

To assist the reader in understanding the current invention, this description will begin with an overview of the major elements of the preferred embodiment followed by a general description of the operation of that preferred embodiment. After this initial description of the construction and operation, detailed specification of the individual elements will be described.

Figure 3A:
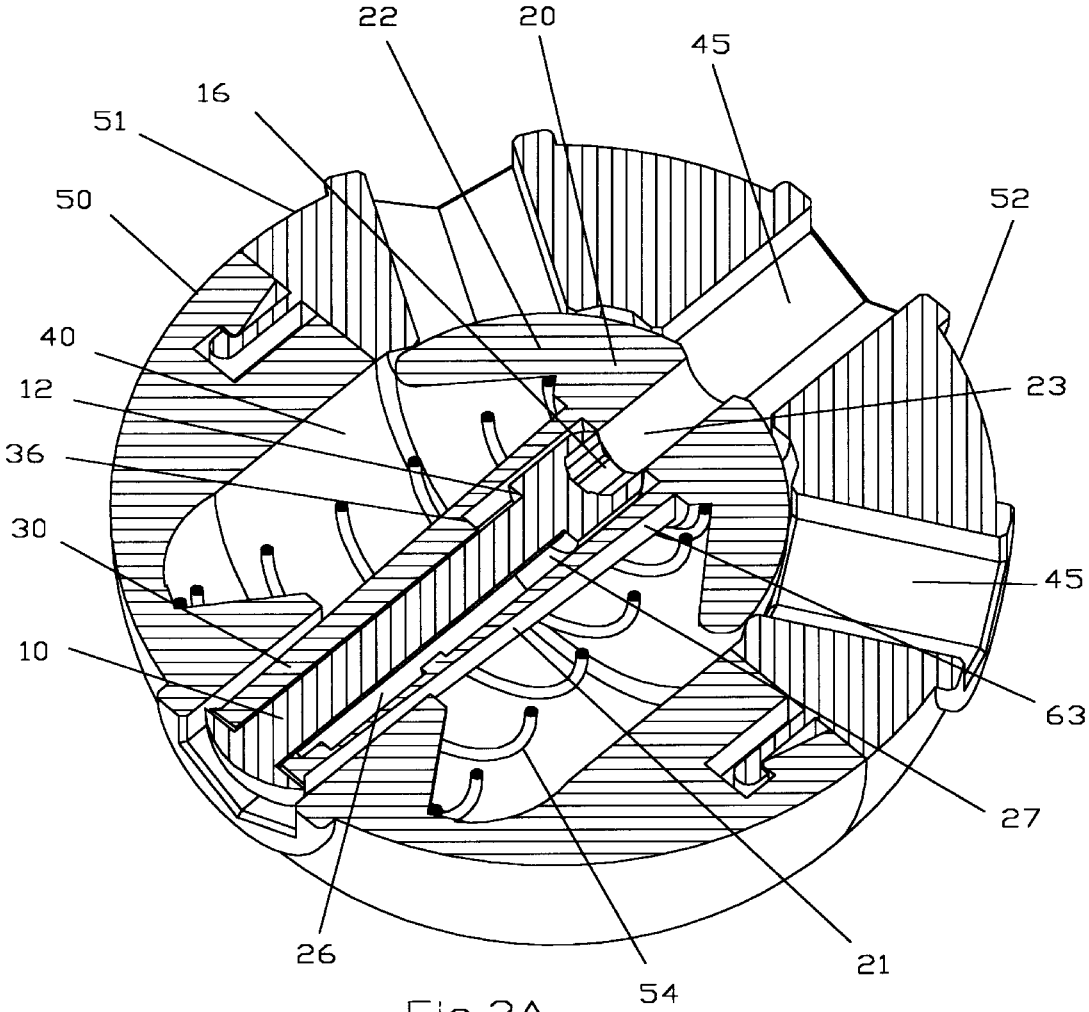
FIG. 3A is an elevated cross-sectional perspective view of the toy construction ball of the preferred embodiment in the disengaged state.

FIG. 1 shows the major elements of the preferred embodiment of the current invention in pre-assembly form. The preferred embodiment is a spherical toy construction ball manufactured as a top hemisphere 52 and a bottom hemisphere 51 that can be snapped together during assembly. The resulting spherical object contains a spring 54 biased, hexagonal shaped, projectable latch mechanism 20 which contains a locking pin 10. FIG. 3A shows a cross-sectional view of these major elements in the assembled configuration. The bias of the spring 54 forces the latch mechanism 20 to retract into a latch housing cavity 40 within the ball when the latch is not engaged. The top hemisphere 52 of the ball contains several strategically arranged hexagonal shaped latch engagement receptacles 45 into which the latch mechanism 20 of one or more similar toy construction balls can be inserted in a rigid but releasable manner. FIG. 1 illustrates the latch mechanism 20 that consists of a latch head 22 and a latch shaft 21. The latch shaft 21 is comprised of three radially expandable prongs 30 that surround a locking pin cavity 26 (not visible in this figure). A separate locking pin 10 is located within this locking pin cavity 26 and is contoured such that it interacts with the inner surface of the prongs 30 in a manner which causes the prongs to expand radially when the locking pin is rotated. Furthermore, the locking pin 10 and the inner surface of the prongs 30 are contoured such that a rotational force can be used to engage the latch mechanism 20, but either a counter-rotational force or a linear force can be used to disengage the latch mechanism 20.

Figure 2:
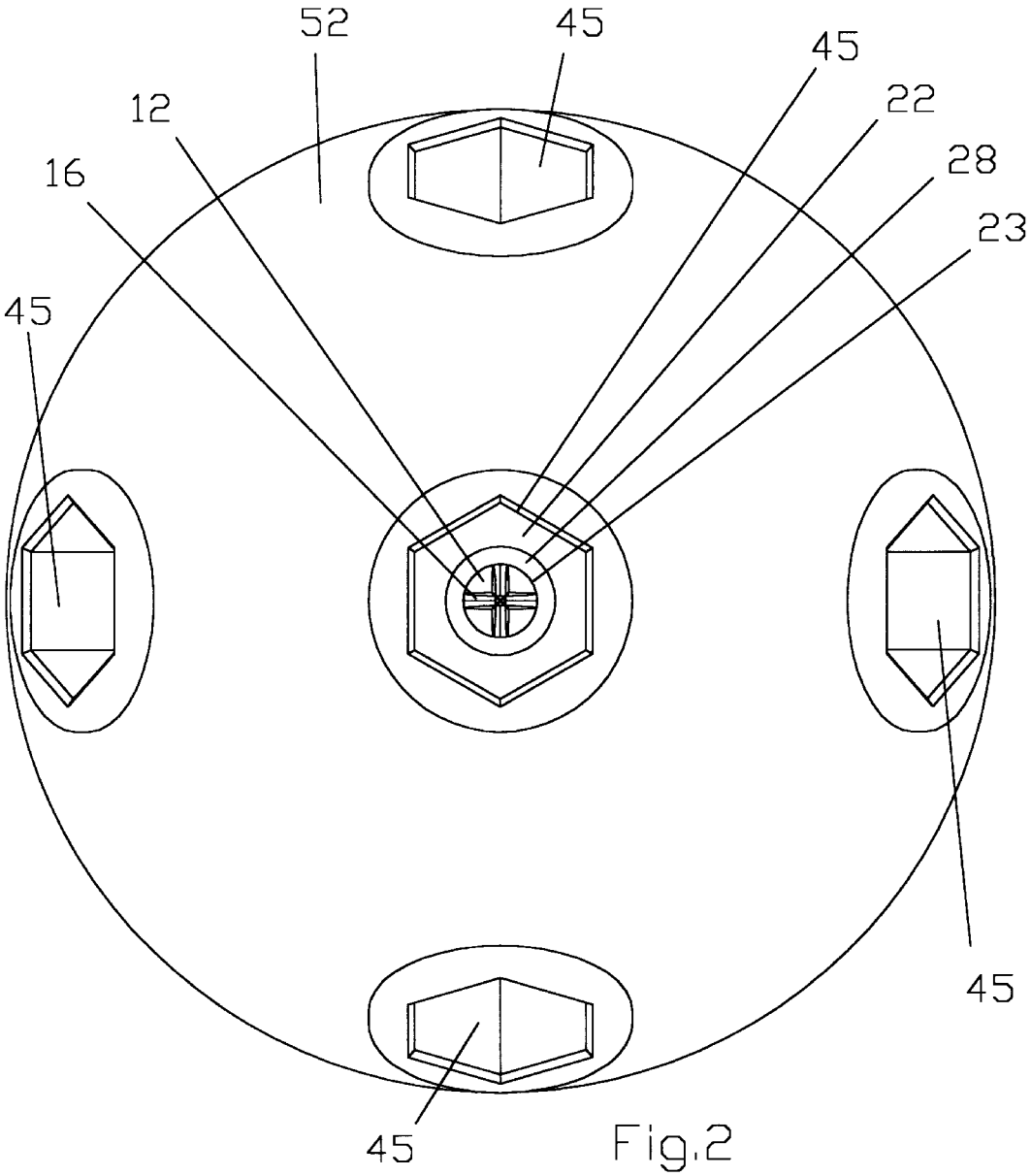
FIG. 2 is a top-view of the assembled toy construction ball of the preferred embodiment, with the locking pin 10 and latch mechanism 20 visible through the hexagonal latch engagement receptacle 45.
Figure 3B:
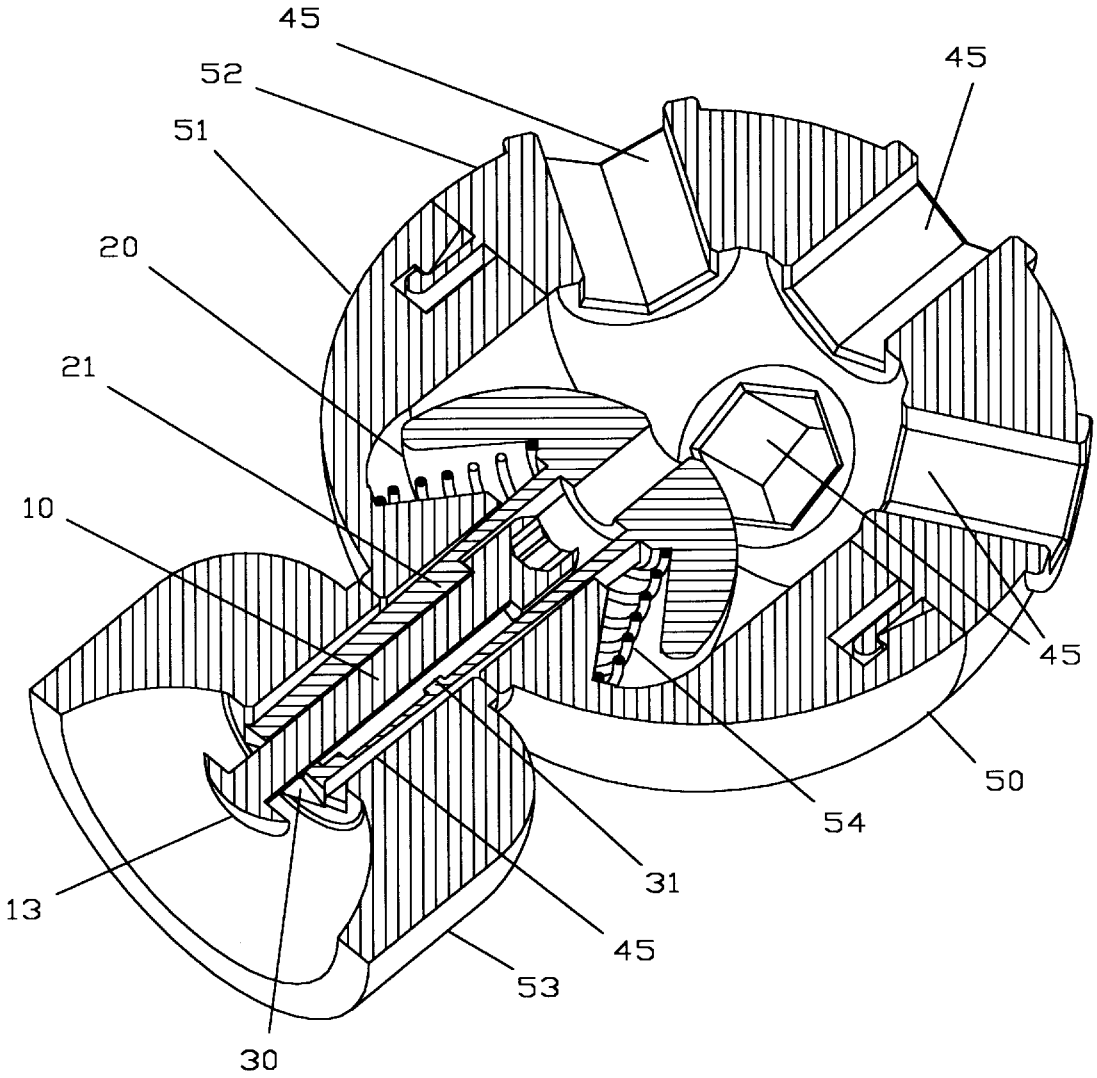
FIG. 3B is an elevated cross-sectional perspective view of the toy construction ball with its latch mechanism 20 inserted into the latch engagement receptacle 45 of a starter block 53 before the latch mechanism 20 is fully engaged.
Figure 3C:
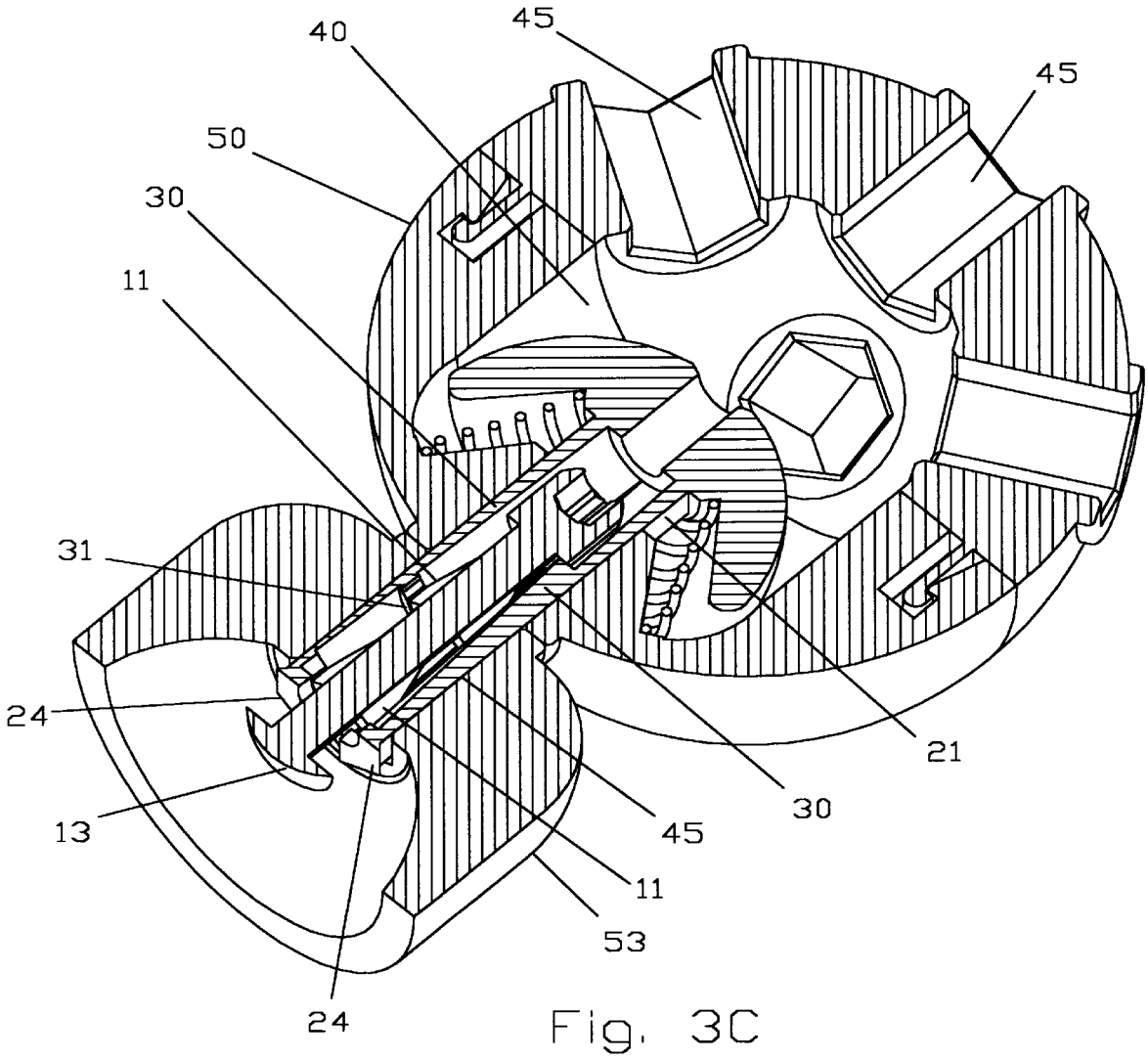
FIG. 3C is an elevated cross-sectional perspective view of the toy construction ball securely fastened to a starter block 53.

FIG. 2 shows a view of a toy construction ball embodiment of the current invention, from a perspective looking directly into the primary latch engagement receptacle 45 which is coincident with the axis of the latch shaft 21 (not shown in this figure). Two toy construction balls can be releasably interconnected by inserting a locking tool through the center-most receptacle 45 of a first ball, then through an engagement tool insertion hole 23 bored axially through the latch head 22, then into a locking tool slot 16 indentation on the locking pin inner head 12. FIG. 3A shows that as the tool is pushed inward, the locking pin inner head 12 presses against a rotation barrier shoulder 36 located on the inner surface of each latch prong 30. Once the locking pin 10 strikes the rotation barrier shoulder 36, additional force applied by the tool causes the entire latch mechanism 22 to be moved against the bias of the spring 54 so that the latch shaft 21 is projected from the opposite side of the ball. FIG. 3B shows the latch mechanism 20 fully projected in this manner. Once fully projected, the latch shaft 21 is inserted into an engagement receptacle 45 on a second similar toy ball, or into a starter block 53 as illustrated in this figure. FIG. 3C shows that once the latch shaft 21 is fully inserted into a receiving latch engagement receptacle 45, the tool can be rotated clock-wise sixty degrees to cause the locking pin fingers 11 to force the latch prongs 30 radially outward into the engaged position. The two objects are then rigidly interconnected, and numerous additional balls can be similarly attached to any remaining unoccupied engagement receptacles 45 on either ball, allowing complex rigid structures to be constructed.

Figure 3D:
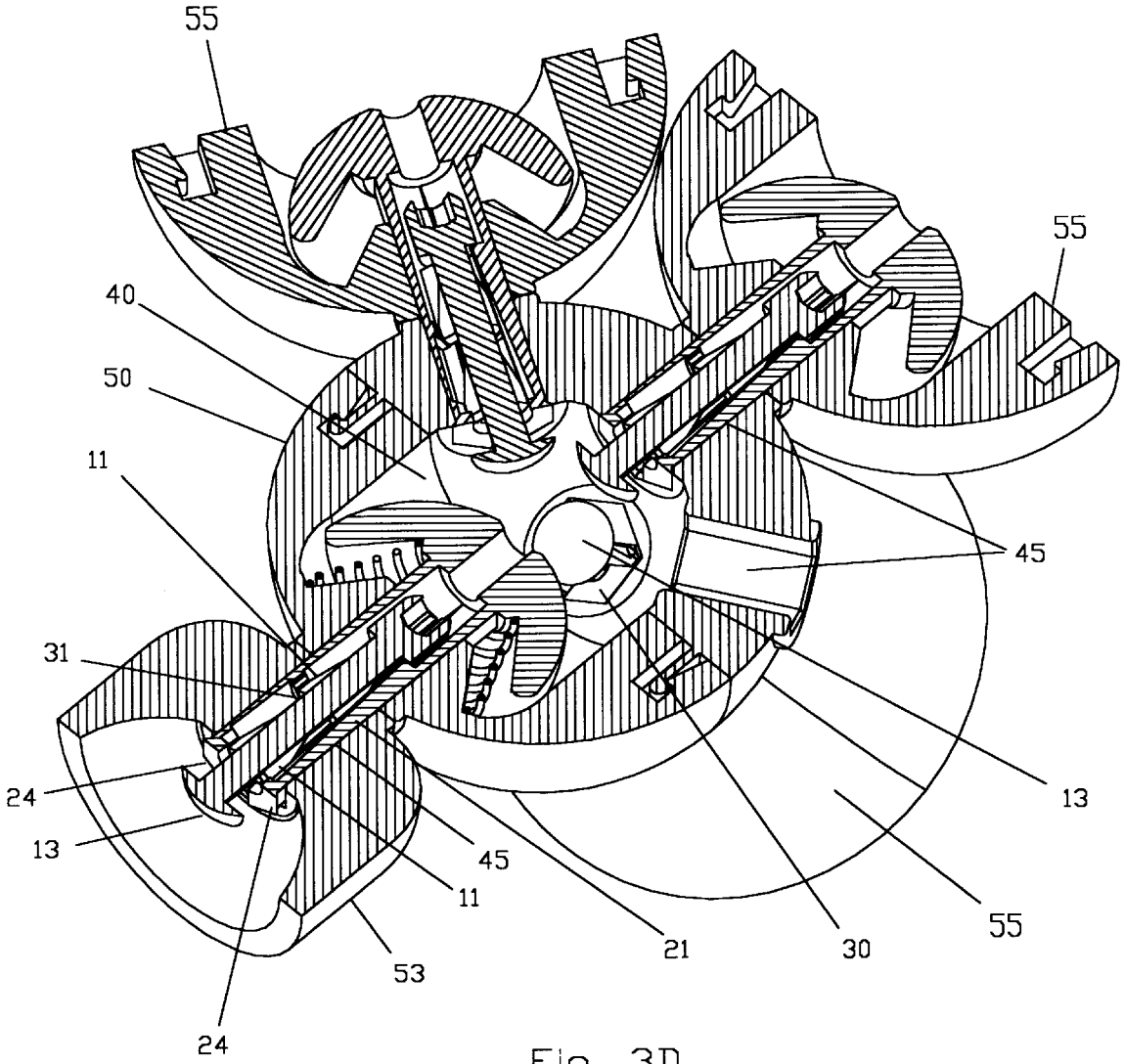
FIG. 3D is an elevated cross-sectional perspective view of the toy construction ball securely fastened to a starter block 53, with the latch shaft 21 and locking pin outer head 13 of several additional toy construction balls visible within the latch trigger chamber 44 of the primary toy ball.

For completeness, FIG. 3D illustrates a plurality of objects interconnected in this manner. The latch mechanism from a primary object 50 is securely attached to the latch engagement receptacle of a special starter block 53. The latch mechanisms 20 and associated outer pin heads 13 of multiple additional toy balls are shown attached to several latch engagement receptacles 45 of the primary object 50. For simplicity in this drawing, the details of these secondary objects such as latch retraction springs 54 and the top hemisphere of each object 56 are omitted. For the preferred embodiment, these secondary objects would be manufactured identically to the primary object 50.

Each latch mechanism 20 is released when a slight force is applied to its locking pin outer head 13, which protrudes slightly from the latch shaft 21 when the latch is engaged. The force on the locking pin outer head 13 is applied in a direction which pushes the locking pin 10 towards the latch's head 22, causing the locking pin fingers 11 to slip off of the latch prong expansion cams 31. Without the fingers 11 positioned to hold the prongs 30 in the expanded position, the prongs quickly return to their relaxed position, which results in a slight inward bias of the prongs 30. This inward bias of the prongs 30 results in negligible friction between the outer surface of the latch mechanism 20 and the wall of the latch receptacle 45, allowing the full force of the compressed spring 54 to quickly retract the entire latch mechanism 20 from the receptacle 45. The proportions of the balls, latch mechanisms, and receptacles are chosen such that the spring-biased retraction of a latch mechanism into its latch housing cavity 40 causes its latch head 22 to impact the locking pins 10 of each interconnected ball, causing their latch mechanisms to also release. Using this preferred embodiment of the current invention, a complex rigid structure can be constructed with multiple similar toy construction balls. That structure can then be disintegrated by triggering the release of a single first latch mechanism so that a cascading release effect is initiated which causes the release of all remaining latches.

The locking pin

Figure 4:
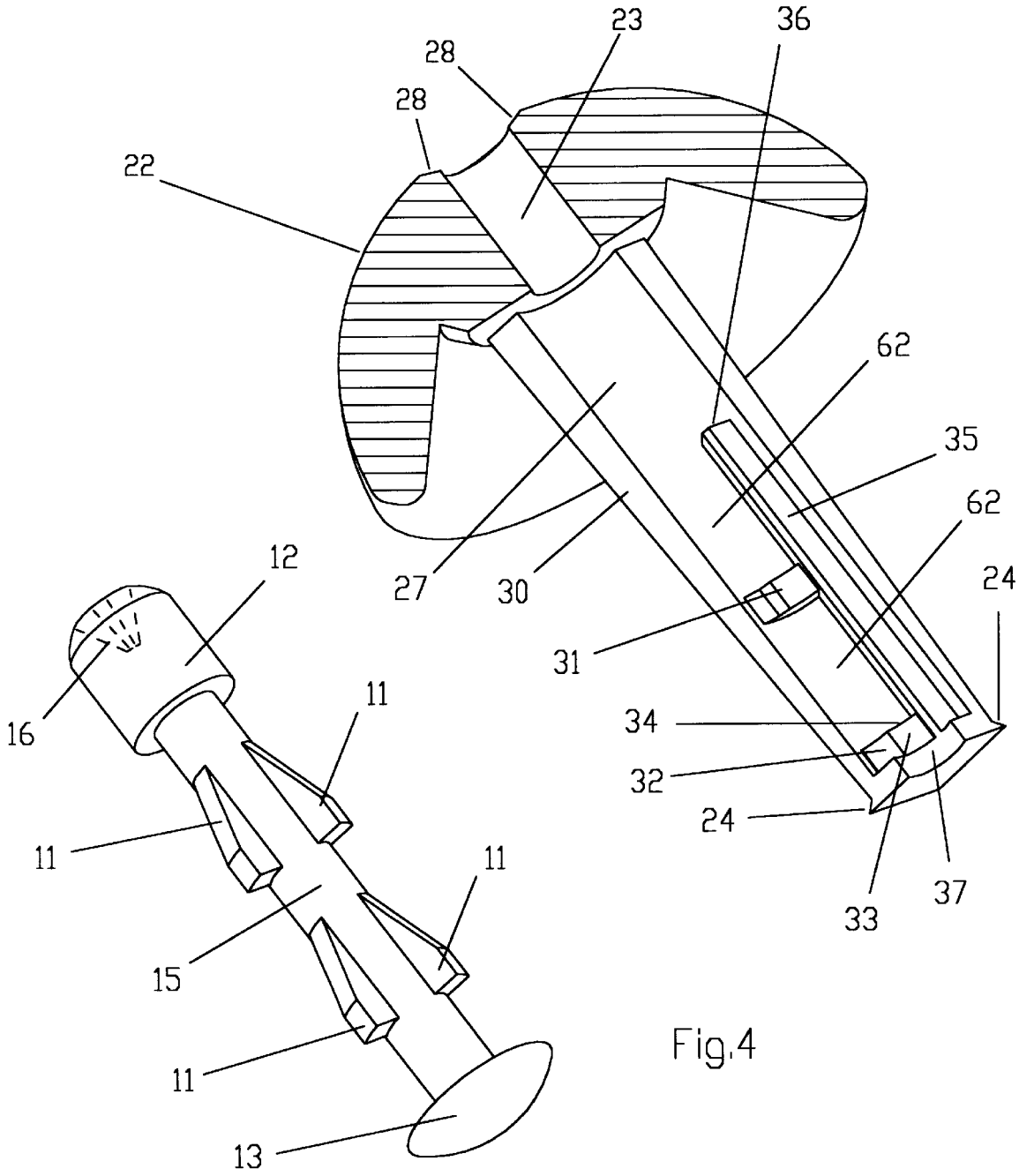
FIG. 4 is an elevated perspective view of the locking pin 10 along with an elevated cross-sectional perspective view of the latch mechanism 20 with two of its three prongs 30 removed such that the inner surface of the remaining prong 30 is exposed.

FIG. 4 illustrates the latch mechanism 20 and the locking pin 10 components of the preferred embodiment of the current invention. In this drawing, two prongs have been omitted from the latch mechanism 20 to expose the inner surface of the remaining prong 30. The locking pin 10 consists of a shaft 15, an outer pin head 13, an inner pin head 12, and multiple locking pin fingers 11. The diameter of the shaft 15 is chosen so as to allow the shaft to fit closely, but not tightly, into the locking pin cavity 26 existing between the concentrically arranged latch prongs 30 when the prongs are in the relaxed position. Since the narrowest diameter of the locking pin cavity 26 is coincident with the rotation barriers 35, the locking pin shaft 15 diameter must be less than the diameter of the locking pin cavity 26 at the rotation barriers 35.

The locking pin inner head

FIG. 4 also illustrates the inner pin head 12 portion of the locking pin 10, which is a cylindrical or semi-spherical attachment to one end of the locking pin shaft 15. The tip of the inner pin head 12 contains a locking-tool slot 16 which is illustrated with hidden lines in the referenced drawing. The locking-tool slot is an indentation suitable for applying a rotational force to the locking pin 10 via a separate tool (not shown). The indentation may be any suitable shape such as a straight slot (e.g. "flat-head" screwdriver style), cross-hatch (e.g. "phillips-head" screwdriver style), or a hexagon shaped (e.g. "allen-wrench" style) indentation. Alternatively, a locking tool protrusion such as a square or hexagon shaped bolt head design may be used, over which an appropriately sized wrench socket style tool could be placed. In the preferred embodiment, the locking-tool slot 16 is a cross-hatch indentation suitable for use with a common household phillips-head screwdriver or a reasonable toy facsimile.

The locking pin outer head

FIG. 4 illustrates that the outer pin head 13 is a semi-spherical attachment to the locking pin shaft 15, which is positioned at the opposite end of the shaft from the inner pin head 12. The radius of the outer pin head may be larger than the distance from the latch shaft center axis to the outer surface of the engagement flanges 24 when the prongs 30 are relaxed. Alternatively, the radius of the outer pin head may be small enough to allow the outer pin head to fit entirely within the locking pin cavity 26. In the preferred embodiment, the outer pin head 13 circumference is slightly smaller than the at-rest radial periphery of the latch prongs 30.

The locking pin fingers

FIG. 4 also illustrates that the locking pin fingers 11 are positioned along the locking pin shaft 15 at angles and offsets which roughly match the angles and offsets of the prong engagement troughs 33 found on the inner surfaces of the latch prongs 30. In the preferred embodiment, the axial location of the prong engagement troughs 33 were chosen to be uniform across all prongs 30. This symmetry is chosen in the preferred embodiment to simplify the manufacturing assembly process, by allowing the locking pin 10 to be inserted into the locking pin cavity 26 at any convenient rotational orientation. Alternatively, the number, size, shape, and position of the prong engagement troughs 33 could vary among the prongs of a single latch mechanism. In such non-symmetrical applications, the size and location of the locking pin fingers 11 along the locking pin shaft 15 should be selected so as to compliment the contour of the inner surface of the latch prongs 10. In such embodiments, it would be necessary to insert the locking pin 10 into the locking pin cavity 26 at the proper rotational orientation during assembly. This is undesirable in the preferred embodiment of a child's construction toy, but is expected to be useful for more industrial applications in which it may be desirable to apply prong expansion pressure in asymmetrical patterns.

The latch and latch materials

FIG. 1 illustrates the preferred embodiment of the latch mechanism 20 of the present invention. The latch shaft 21 consists of two or more prongs 30 arranged symmetrically around the center axis of the latch, with a three pronged embodiment represented in all figures. The prongs 30 are attached to the latch head 22 in a rigid yet flexible manner. In the preferred embodiment, the entire latch is constructed of injection molded plastic. A latch engagement flange 24 is located at the end of each prong 30 farthest from the latch head 22, and on the surface of the prongs farthest from the latch axis. The angle formed along the outer surface of the prongs 30 where the prong shaft 21 meets the engagement flange 24 may be obtuse or right angled, but should not be acute as such would interfere with the disengagement action of the invention. The preferred embodiment demonstrates an obtuse angle between the prong shaft 21 and the engagement flange 24. In the relaxed state, the prongs 30 extend from the latch head 22 with an inward bias such that the distance from the latch center axis to the outer edge of the engagement flange 24 is slightly less than the distance from the latch center axis to the outer surface of the prongs at the point where the prongs 30 attach to the latch head 22. This intersection of the prong shaft 21 with the latch head 22 is the latch prong stress zone 63. The precise cross-sectional shape and thickness of the prong 30 in the area of the prong stress zone 63 is chosen based on the materials selected to be flexible enough to allow the prongs 30 to be forced radially outward during latch engagement, yet resilient enough to quickly draw the prongs back to their inwardly biased orientation when the prong expansion force is removed.

The inner surface of the prongs

Figure 7A:
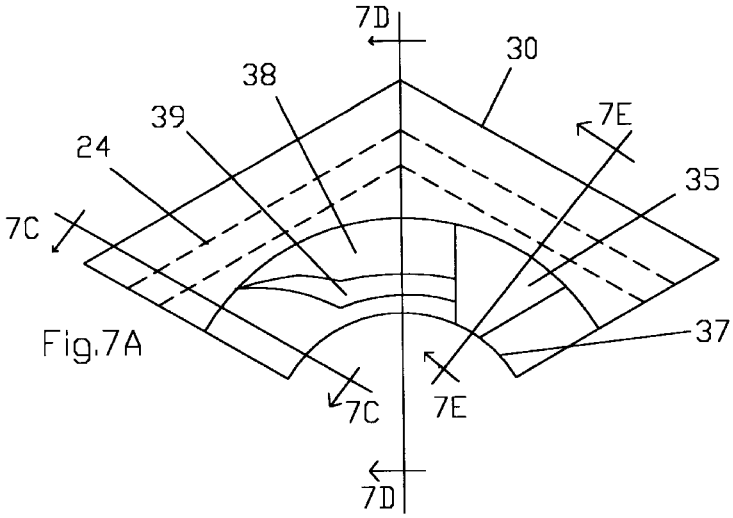
FIG. 7A is a top-view illustration of a single latch prong 30, showing the cross-section perspective lines for each of the three major longitudinal regions of each prong 30.
Figure 7B:
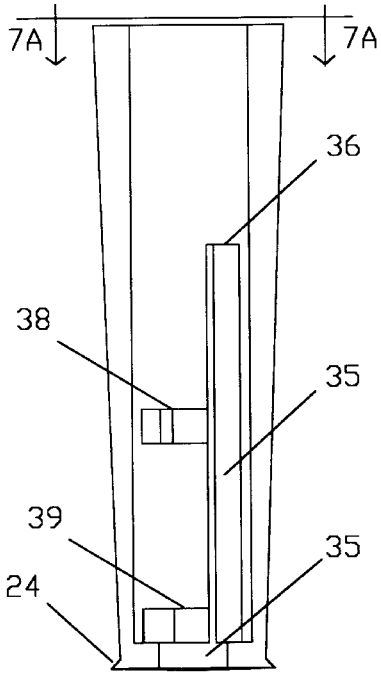
FIG. 7B is a front-view illustration of a single latch prong 30, showing the perspective line for FIG. 7A.
Figure 7C:
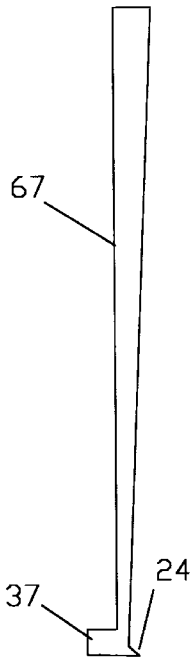
FIG. 7C is a longitudinal cross-section of the latch prong 30 coincident with the float zone region.
Figure 7D:
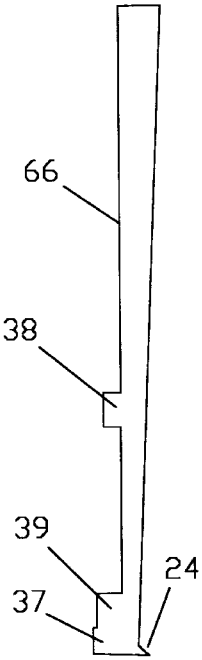
FIG. 7D is a longitudinal cross-section of the latch prong 30 coincident with the expansion cam region.
Figure 7E:
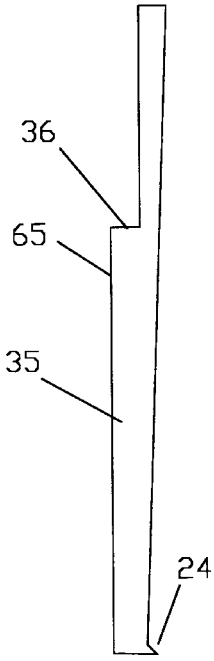
FIG. 7E is a longitudinal cross-section of the latch prong 30 coincident with the rotation barrier region.

FIG. 7B illustrates a front-view perspective of a single latch prong 30. This perspective illustrates the relative location and orientation of the major contour features of the inner prong surface. FIG. 7A illustrates an end-view of this single latch prong 30 from the perspective coincident with the position where the prong would ordinarily attach to the latch head 22 (not shown in this figure). Annotated on this figure, are three additional cross-sectional perspective lines. These cross-sections demonstrate the three major regions that comprise each latch prong. These regions are referred to as the rotation barrier region 65, the expansion cam region 66, and the float zone region 67. Each of these regions has a specific contour when viewed from the side-view perspective, and these contours are important to the proper operation of the preferred embodiment of the current invention. FIG. 7C, 7D, and 7E illustrate axial cross-sections of the latch prong 30 and locking pin 10 in each of these three regions.

FIG. 7C illustrates that the float zone region 67 extends for the full axial length of the prongs 30, from the latch head 22 to the locking pin shaft guide 37, with no distinguishing contours. The radius of the locking pin cavity 26 in the float zone region 67 is greater than the outside diameter of the locking pin fingers 11. This allows the locking pin 10 to move without encumbrance when the rotational orientation of the locking pin 10 is such that the locking pin fingers 11 are aligned with the float zone region 67.

FIG. 7E illustrates a cross-section of the rotation barrier region 65 of the latch prongs 30. The rotation barrier 35 extend for a substantial portion of the axial length of the prongs 30, from the inner pin head cavity 27 to the locking pin shaft guide 37 area. In the rotation barrier region 65, the inner surface of the latch prongs 30 contain a physical characteristic referred to as a rotation barrier 35. The rotation barrier 35 creates a shoulder 36 which prevents the locking pin 10 from being removed from the inner-pin head cavity 27. The rotation barrier 35 also serves to constrain the rotational motion of the locking pin 10 so that the locking pin fingers 11 cannot be rotated past the latch prong expansion cams 31 during latch engagement. As such, the diameter of the locking pin cavity 26 at the rotation barrier 35 is less than the diameter of the locking pin cavity 26 at the latch prong expansion cam 31. The rotation barriers 35, being the largest features on the inner surface of the prongs 30, define the minimal radius of the locking pin cavity 26. The radius of the locking pin shaft 15 of the preferred embodiment is selected to be less than this minimal locking pin cavity 26 radius, so that the locking pin may move freely within the cavity 26.

FIG. 7D illustrates the expansion cam region 66 of the prongs 30. The expansion cam region 66 contains one or more prong expansion cams 31, with two cams per prong being represented in the preferred embodiment. The prong expansion cams 31 are located on the inner surface of the prongs 30 occasionally along the axial length of the prongs. FIG. 4 illustrates that each prong expansion cam 31 consists of a prong engagement ramp 32, an engagement trough 33, and a prong release ramp 34. The engagement ramp 32 provides a gradual transition from the float zone region 67 diameter of the locking pin cavity 26 to the engagement trough 33 diameter of the locking pin cavity 26, allowing the locking pin fingers 11 to gradually press the prongs outward as rotational force is applied to the locking pin 10. The engagement trough 33 portion of each expansion cam 31 provides an area for the locking pin fingers 11 to remain stable while the latch mechanism 20 is engaged. The engagement trough 33 is bounded radially by the engagement ramp 32 on one side and the rotation barrier 35 on the other side. Axially, the engagement trough 33 is bounded by the prong release ramp 34. The prong release ramp may provide either an abrupt or a gradual transition from the engagement trough 33 to the pin release zone 62. All figures demonstrate an abrupt transition in which the locking pin fingers 11 will quickly fall off of the prong engagement cams 31 when an inward axial force is applied to the locking pin outer pin head 13. The pin release zone 62 creates an empty volume where the locking pin fingers 11 will not interfere with the natural inward bias of the latch prongs 30. In the preferred embodiment, the pin release zone 62 is given the same radial dimensions as the float zone region 67 such when viewing an end-view of the prong 30 at a cross-section coincident with a pin-release zone 62, the inner prong surface boundary between the pin release zone 62 and the float zone region 67 is indistinguishable.

The latch head and spring

FIG. 3A illustrates several additional important features of the preferred embodiment of the current invention. The circumference of the latch head 22 is sufficiently larger than the circumference of the latch shaft 21 as to allow a cylindrical, conical, or other appropriately shaped latch retraction spring 54 to be placed over the latch shaft in a manner in which the latch head serves as a spring stop. In the preferred embodiment, the latch retraction spring 54 is conical in nature. An engagement tool insertion hole 23 is bored or molded along the center axis of the latch mechanism such that it extends entirely through the latch head 22 into the inner pin head cavity 27. The diameter of the engagement tool insertion hole 23 is smaller than the diameter of the locking pin inner head 12, so as not to adversely impact the structural integrity of the latch prong stress zone 63, and to prevent the locking pin 10 from falling out of the locking pin cavity 26 through the latch head 22.

Latch materials

The entire latch mechanism 20, consisting of the latch head 22, prongs 30, and associated prong features such as engagement flanges 24, engagement cams 31, rotation barriers 35, engagement ramp 32 and release ramps 34, is fabricated as a single component. The latch mechanism 20 can be fabricated from any material which can withstand repeated slight bending of the prongs 30 outward to the point where the inward bias of the outer prong surfaces is negated, which can do so without fracturing or stress fatigue, and which will quickly and repeatedly return to its original shape after being bent, such as nylon, rubber or various other materials. In the preferred embodiment, the latch mechanism is fabricated using injection molded plastic.

The inner pin head cavity

FIG. 4 illustrates that the contoured the inner surfaces of the three concentrically arranged latch prongs 30 will create an empty volume referred to as the locking pin cavity 26 (two prongs not shown in this figure). The portion of that empty volume that is bounded by the latch head 22 and the rotation barrier shoulder 36 is referred to as the inner pin head cavity 27. When viewed from an end-view of the locking pin (not shown) the centers of the inner pin head 12, outer pin head 13, and locking-tool slot 16 are all coincident with the center axis of the locking pin shaft 15. The axial length of the inner pin head 12 must be less than the axial length of the inner pin head cavity 27 in order to allow the locking pin 10 to move along the axis of the latch mechanism. Referring to FIG. 7D, the degree of motion provided by this difference in axial length much be sufficient to allow the locking pin fingers 11 to move between the pin release zone 62 and the engagement cam 31 zone of the latch prong inner surfaces. The diameter of the inner pin head 12 is chosen to be small enough as to allow the inner pin head to move freely within the inner pin head cavity 27 of the latch mechanism 20, but large enough that the inner pin head 12 cannot be moved past the rotation barrier shoulder 36. The rotation barrier shoulder 36 prevents the locking pin 10 from being removed from the locking pin cavity 26 unless the latch prongs 10 are forceably bent radially outwards by some means not normal to the intended application, allowing the inner pin head 12 to slip past the rotation barrier shoulder 36.

Partial assembly

Once the latch mechanism 20 and locking pin 10 are constructed based on the complete specifications described above for these two elements of the preferred embodiment of the current invention. The locking pin 10 is then inserted into the latch mechanism 20. Insertion is performed by forcing the locking pin 10 into the locking pin cavity 26 created by the concentrically arranged latch prongs 30. The locking pin 10 is inserted inner pin head 12 first. During this assembly step, the latch prongs 30 will be forced outward by the pressure of the inner pin head 12 on the rotation barrier 34. This instance of flexing the prongs outward will represent the greatest amount of stress on the latch prongs 30 so that the inner pin head 12 can be forced into the inner pin head cavity 27. The materials selected, the inner pin head 12 diameter, and the rotation barrier 35 diameter are all be selected such that this stress on the prongs 30 does not fracture or bend the prongs 30.

Features of the object containing the inventive latch mechanism

Figure 8:
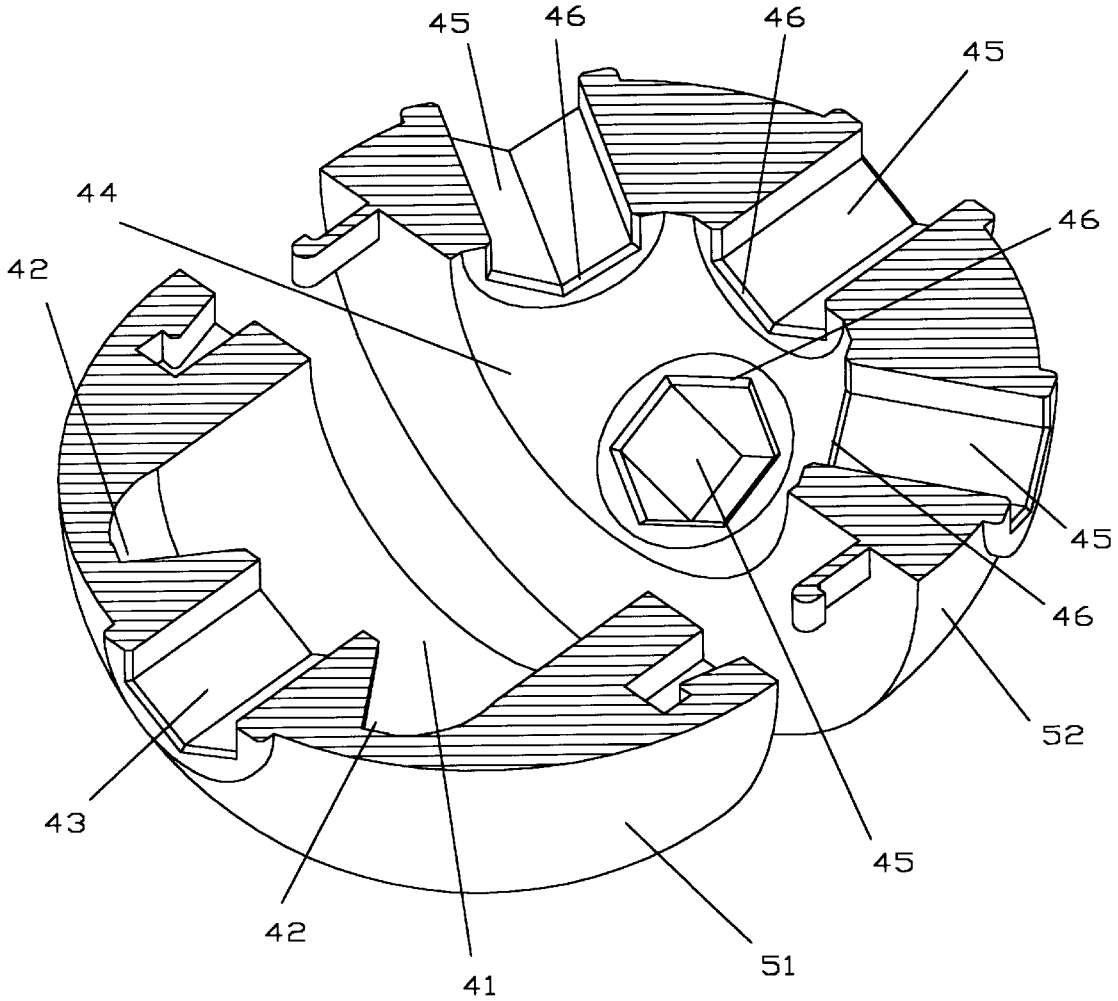
FIG. 8 is an elevated cross-sectional perspective view of the two halves of the toy construction ball of the preferred embodiment, illustrating the latch housing cavity 40 in which the latch mechanism 20 resides, along with various other features of the inner surface of the latch prong 30.

FIG. 8 illustrates the latch housing cavity 40 features of the present invention. The latch housing cavity 40 is an empty volume contained within whatever object embodies the cascading latch mechanism of the current invention. In the case of the preferred embodiment, that object is a toy construction ball created from two hemispheres that are snapped together during assembly. The latch housing cavity 40 consists of a spring compression area 41, a latch trigger chamber 44, and a latch projection guide 43. The latch projection guide 43 is part of the bottom hemisphere 51 and is similar in both radial size and cross-sectional shape to the latch engagement receptacles 45 located on the top hemisphere 52. A latch housing spring stop 42 is created by a trough which surrounds the latch projection guide 43. The thickness of the walls of the object which embodies the latch housing cavity 40 are chosen based on the materials selected and on the spring coefficients selected for the preferred embodiment, so as to allow the spring 54 to be repeatedly compressed and released without structural failure of walls of the object in the area of the latch housing spring stop 42. The spring compression area 41 is an empty volume in the bottom hemisphere 51 of the object, which provides room for the latch mechanism 20 (not shown in this figure) to move and for the spring 54 (not shown in this figure) to compress. The latch trigger chamber 44 is an empty volume within the top hemisphere 52 of the object. When assembled, the latch trigger chamber 44 and the spring compression area 41 create a contiguous empty volume referred to as the latch housing cavity 40. The size and shape of the latch trigger chamber 44 is chosen in such a manner as to allow the latch head 22 to fit smoothly into the trigger chamber while lightly touching the trigger chamber 44 walls evenly over a predominance of the latch head's 22 surface area. The latch engagement receptacles 45 of the object include latch receptacle flanges 46 at the point where the receptacles enter the latch trigger chamber 44. These latch receptacle flanges 46 are sized and angled such that they mate with the latch engagement flanges 24 of any latch prongs 30 that might become interconnected with the object. While the preferred embodiment utilizes a semi-spherical latch head 22 and similarly sized semi-spherical trigger chamber surface 44, alternative non-spherical polyhedron shapes would suffice and will be preferable for specific applications.

Manufacturing and Assembly Considerations

For the preferred embodiment of the invention, the latch mechanism 20, locking pin 10 and the two hemispheres of the toy construction ball 51 and 52 would be constructed in four-piece injection molded fashion. During manufacturing assembly of the construction toy, the locking pin 10 would be pressed forcefully into the locking pin cavity 26. The rounded shape of the locking pin inner head 12 allows it to be inserted head-first between the latch prongs 30 without damaging the prong expansion cams 31. As the locking pin 10 is inserted, the prongs 30 would be forced outward substantially beyond their normal operational flex. Once the locking pin 10 is fully inserted to the point where the locking pin inner head 12 occupies the inner pin head cavity 27, the resilience of the prongs 30 will cause them to return to their normal at-rest inward bias. For the preferred embodiment, the toy construction ball is manufactured as two hemispheres in which the latch projection guide 43 is centered on one hemisphere, and numerous latch engagement receptacles 45 are molded into the opposite hemisphere. The spring 54 selected for the preferred embodiment is conical in nature, and the smaller end is oriented to rest against a latch head spring stop 25. The latch head spring stop 25 is a trough which encircles the latch prongs 30 on the underside of the latch head 22. During assembly, the spring 54 is inserted over the latch mechanism 20 (containing the locking pin) and into the spring stop created by the cup formation of the latch head 22. The latch mechanism and spring are then inserted into the bottom hemisphere 51 of the such that the latch shaft 21 is positioned within the latch projection guide 43. Finally, the top hemisphere 52 of the toy is attached to the bottom hemisphere 51 via some permanent bonding means such as epoxy compound, thermal bonding, or locking tabs molded into each hemisphere. In the figures illustrating the preferred embodiment, locking tabs are shown. Alternatively, the toy construction ball application of the preferred embodiment could use semi-permanent hemisphere attachment means such as screws, threaded rims, or other means so that the hemispheres can be separated during play. This will allow the user to utilize interchangeable latch mechanisms (e.g. hexagonal shaft, cylindrical shaft, etc.). When a clear plastic is used for the casing, separable hemispheres could also allow decorated paper segments to be inserted inside the balls to allow individual users to personalize or otherwise decorate their structures.

OPERATION OF INVENTION

FIG. 2 illustrates a top view of a toy construction ball of the preferred embodiment, which contains the cascading release latch mechanism 20 of the present invention. From the illustrated perspective, the reader is looking into the particular latch engagement receptacle 45 which happens to be coincident with the center axis of the latch shaft 21 and which is located opposite from the latch projection guide 43. Looking into the hexagonal shaped engagement receptacle 45, the user can see the portion of the latch head 22 into which the engagement tool insertion hole 23 is bored. Looking through this tool insertion hole 23, the user can see a portion of the locking pin inner head 12, into which a locking tool slot 16 is indented. From this perspective, the user has an unobstructed path for inserting a tool (not shown) into the locking tool slot 16.

Figure 5A:
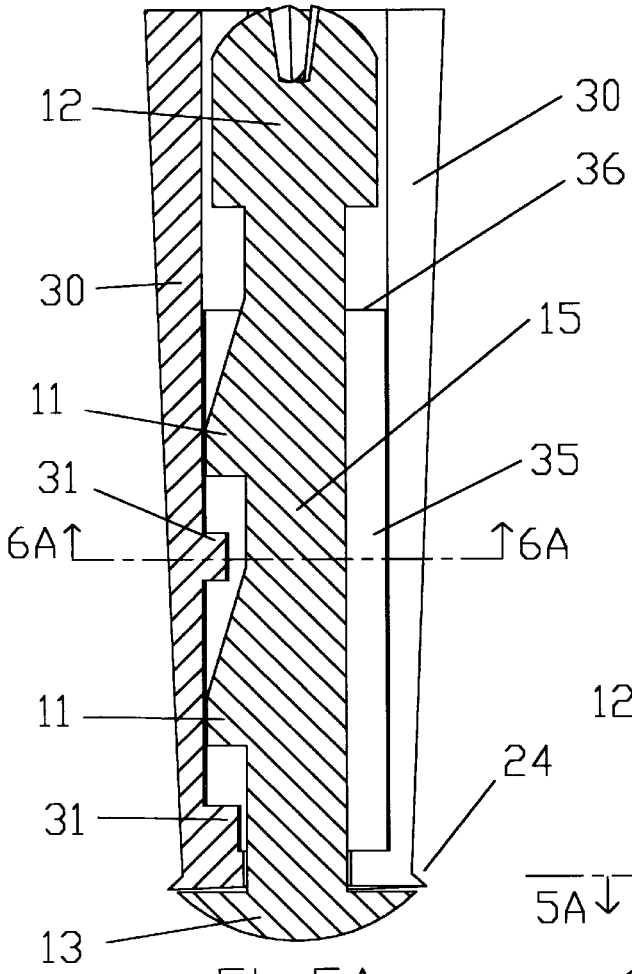
FIG. 5A through 5D are cross-sectional front-views of the latch shaft 21 with the locking pin 10 resident in the locking pin cavity 26. These views illustrate the axial and radial orientation of the locking pin 10 relative to the latch prongs 30 at each of the four operational steps used to engage the latch mechanism of the preferred embodiment.
Figure 6A:
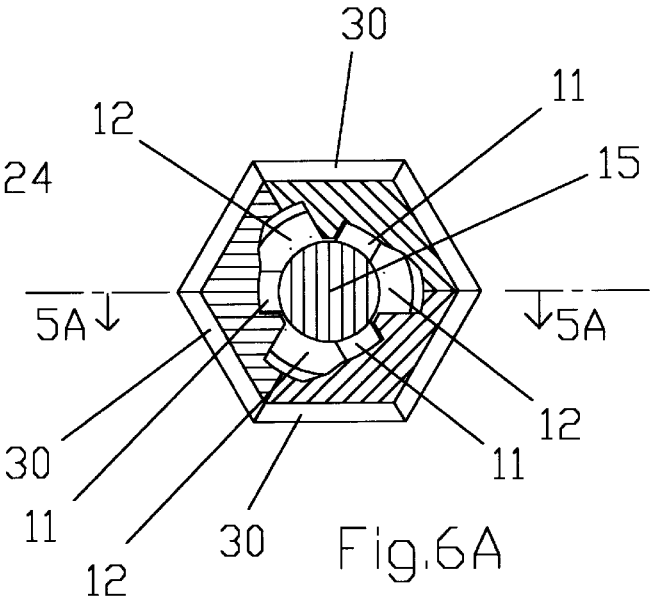
FIG. 6A through 6D are cross-sectional bottom-views of the latch shaft 21 with the locking pin 10 resident within the locking pin cavity 26. These views illustrate the axial and radial orientation of the locking pin 10 relative to the latch prongs 30, corresponding to each of the four operational steps illustrated in FIG. 5A through FIG. 5D, respectively.
Figure 5B:
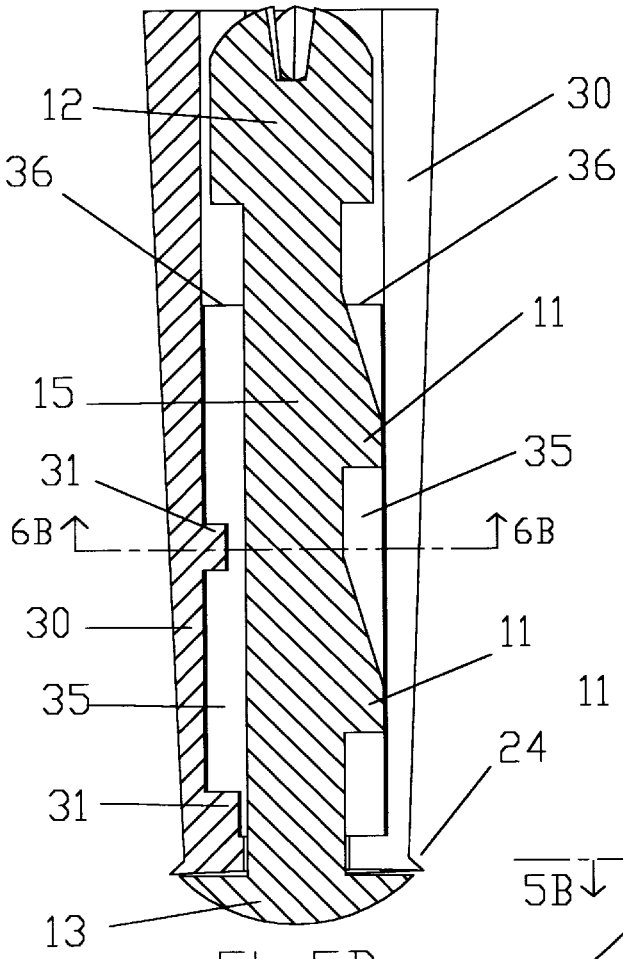

FIG. 3A illustrates a cross-sectional view of the primary object 50 in its disengaged orientation. To connect the primary object 50 to a starter block 53 (not shown in this figure), an engagement tool such as a phillips head screwdriver or a reasonable toy facsimile is inserted into the locking tool slot 16. FIG. 6A illustrates that the rotational orientation between the locking pin 10 and the locking pin cavity 26 prior to inserting the tool. FIG. 5A illustrates the axial orientation between the locking pin 10 and the locking pin cavity 26 prior to inserting the tool. FIG. 3A illustrates the orientation between the latch mechanism 20 and the latch housing cavity 40 prior to inserting the tool.

Figure 6B:
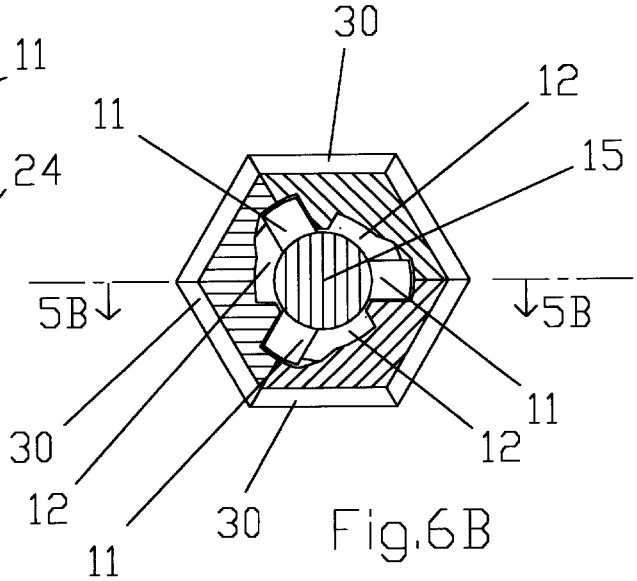
Figure 5C:
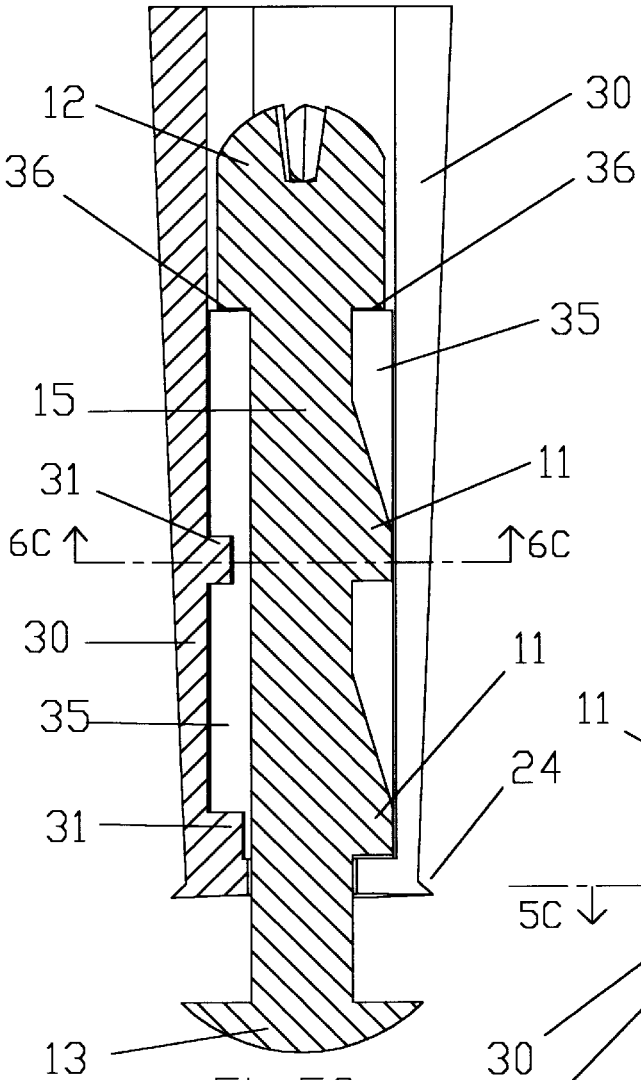

Once the tool is inserted into the tool slot 16, it is rotated roughly 60 degrees counter-clockwise. At this angular orientation, illustrated in FIG. 6B, the locking pin fingers 11 are positioned in the float zone region 67 of the contoured inner surface of the latch prongs 30. Since the float zone region 67 extends for the entire axial length of the prong shaft 21 (as illustrated in FIG. 7C), the locking pin 10 may now be pushed with the engagement tool without causing the prong expansion cams 31 to interfere with the locking pin fingers 11. This is important because it is undesirable for the latch prongs 30 to be inadvertently expanded as this point, since the latch shaft 21 has yet to be inserted into an engagement receptacle 45 of any secondary object. As the tool is then pushed further, the flat underside of the locking pin inner head 12 strikes the rotation barrier shoulder 36 preventing any further movement of the locking pin 10 relative to the latch shaft 21. The resulting linear orientation of the locking pin 10 relative to the latch shaft 21 is illustrated in FIG. 5C. This linear displacement also results in a different cross-sectional orientation between the locking pin fingers 11 and the prong expansion cams 31, which is also evident in both FIG. 5C and FIG. 6C. At this point, the locking pin fingers 11 are situated radially in the float zone region 67 and axially adjacent to the latch prong expansion cams 31. Continued force applied to the engagement tool causes the inner pin head 12 to press against the rotation barrier shoulder 36 forcing the latch shaft 21 to be projected out of the latch projection guide 43. As this motion continues, the latch head 22 pushes on the spring 54 forcing it to compress. This spring compression creates a bias on the entire latch mechanism 20, urging the latch mechanism to return to the retracted position.

Figure 6C:
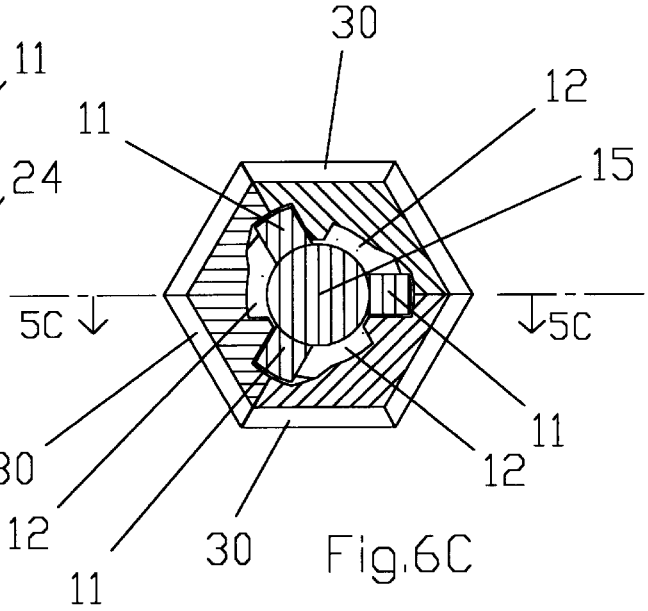
Figure 5D:
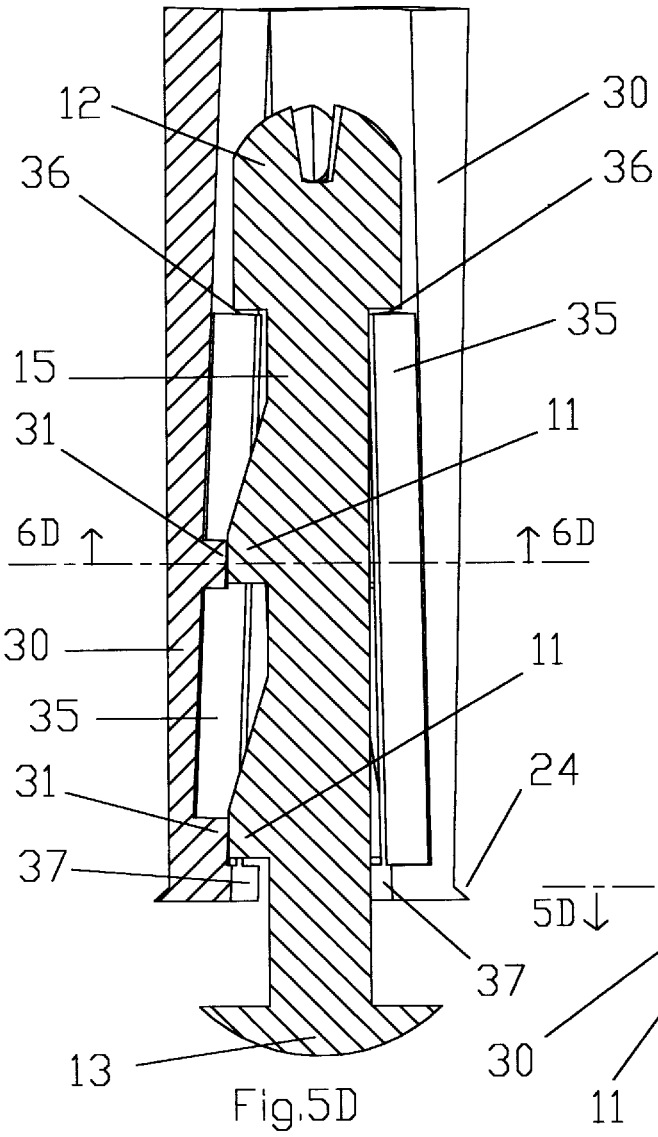
Figure 6D:
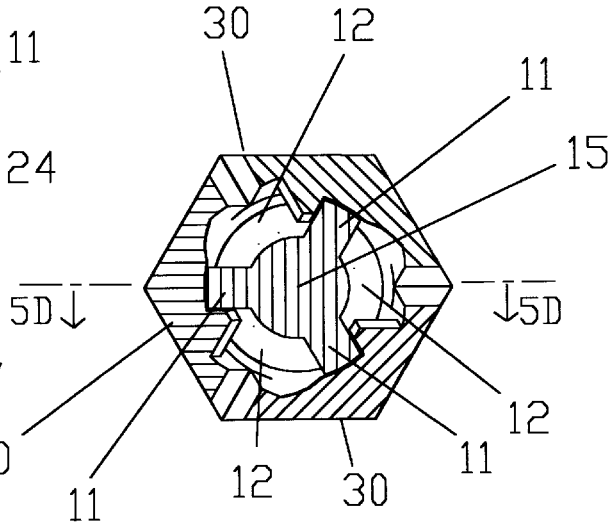

FIG. 3B illustrates that once the latch is completely projected from the primary object 50, the latch shaft can be inserted into any available latch engagement receptacle 45 on any secondary object, which in this case will be a special starter block 53. Once the projected portion of the latch shaft 21 is fully inserted into an available receptacle 45, the engagement tool is rotated roughly sixty degree in the clockwise direction. FIG. 6C shows the rotational orientation of the locking pin 10 and latch prong 30 immediately prior to executing this sixty degree clock-wise rotation of the locking tool. Since this figure shows a perspective which would represent a bottom-view of the locking tool (not shown), a clock-wise rotation of the locking tool by the user will result in a counter clock-wise rotation of the locking pin 10 within the referenced figure. With this in mind, FIG. 6C shows that rotation of the locking tool will cause the locking pin fingers 11 to interact with the prong expansion ramp 32, forcing the latch prongs 30 outwards. This action continues until the rounded outer edge of the locking pin fingers 11 slip over a slight lip at the edge of the engagement ramp 32 and settle into the engagement trough 33. FIG. 6D illustrates the positions of the locking pin 10 and latch prongs 30 at this point in time. The slight lip which creates the expansion cam trough 33 prevents the pin from inadvertently slipping back down the engagement ramp 32 after the engagement process is completed. Once the tool is turned roughly sixty degrees, the locking pin fingers 11 hit the rotation barrier 35 which prevents any further angular movement. At this point, the latch prongs are fully expanded as shown in FIG. 3C, so the latch engagement flange 24 interacts with the inner surface of the engagement receptacle 45 of the starter block 53, preventing the latch shaft 21 from retracting back into the latch housing cavity 40. This is the engaged position of the present invention.

Once the primary object 50 is securely attached to a secondary object, which in this initial case happens to be a starter block 53, all of the engagement receptacles 45 of the primary object become available for the attachment of additional objects. FIG. 3D illustrates the latch housing cavity 40 of the primary object 50 after several additional secondary objects have been interconnected to the primary object 50. Similarly, additional objects may be latched to each of these secondary objects, allowing the user to create a large three-dimensional structure. In this figure (FIG. 3D), a portion of three such secondary objects' latch prongs 30 are visible. Two of these secondary objects have been attached in a plane that is common with the primary object 50 and the starter block 53, allowing those two secondary objects 55 to also be shown in cross-section. The third secondary object 55 is shown attached to the particular latch engagement receptacle 45 of the primary object 50 which happens to point generally away from the viewer. As such, this third ball is not aligned in a common plane with the remaining balls, so it is not shown in cross-section. The locking pin outer heads 13 of each of these interconnected secondary objects 55 are shown to be accessible in the latch trigger cavity 44 of the primary object 50. The specific positioning of the latch engagement receptacles 45 on the surface of each object may vary from object to object depending on the geometrical structures which the manufacturer wishes to provide. FIG. 3D illustrates that the latch engagement receptacles 45 can easily be placed in positions on the surface of the ball which allow three dimensional structures to be assembled.

To disintegrate the structure illustrated in FIG. 3D, a user simply pushes the locking pin outer head 13 of the primary object 50 which is clearly exposed in a recess within the starter block 53. This force applied to the locking pin outer head 13 forces the locking pin fingers 11 to slip off of the prong engagement cams 31. Once the locking pin fingers 11 slip entirely into the pin release zone 62, the resiliency and inward bias of the latch prongs 30 causes them to quickly return to the unexpanded state. When not expanded, there is virtually no friction existing between the latch shaft 21 of the primary object, and either the engagement receptacle 45 into which it was inserted or the latch projection guide 43 from which it was projected. In this virtually frictionless state, the latch retraction bias of the compressed spring 54 causes the entire latch mechanism 20 to snap quickly back into its latch housing cavity 40. As the latch retracts quickly into its housing, the latch head 22 strikes the locking pin outer heads 13 of any latch mechanism(s) 20 that happen to be attached to the receptacles 45 of the releasing primary object 50. The characteristic and coefficients of the spring 54 are selected so as to insure that the momentum of the quickly retracting latch mechanism 20 is sufficient to overcome the static friction of each locking pin 10 struck by the quickly retracting latch head 22. The impact of the retracting latch head 22 on each of the outer pin heads 13 occupying the primary object's latch trigger chamber 44, causes those secondary latches to release in a similar manner, ad infinitum. Thereby, the single initial trigger event of the user pressing the locking pin outer head 13 within the starter block 53 causes a dramatic cascading chain-reaction to be initiated. The cascading release of the latches results in a rapid disintegration of the entire structure, offering tremendous excitement and play value for the user.

Other Considerations and Embodiments

To reduce the complexity of the figures used to illustrate the preferred embodiment of the current invention, the two hemispheres 51 and 52 of the toy construction ball of the preferred embodiment are shown as solid plastic except where critical features of the invention require otherwise. To reduce weight and manufacturing costs, it is envisioned that each of these hemispheres 51 and 52 would be hollow such that there is a void between the wall of the latch housing cavity 40 and the outer surface of the ball. The selection of hollow or solid, as well as the precise shape and surface texture of the toy balls are design details that can be modified without adversely impacting the operational effectiveness of the inventive latch mechanism. It is envisioned that many shapes for the construction toy will be used as alternatives or compliments to the general spherical nature of the preferred embodiment, including both regular and irregular polyhedrons.

In the preferred embodiment of the current invention, the outer surface of the latch shaft 21 is hexagonal in shape, and the latch engagement receptacles 45 and latch projection guide 43 are also hexagonal in shape. This embodiment will exhibit operational characteristic of preventing two objects from being rotated relative to one another while interconnected. While the hexagonal shaped latch shaft 21 is selected for the preferred embodiment to compliment the three-pronged embodiment, any number of regular or irregular polygon shapes would prove equally adequate. Furthermore, the use of irregular polygon shaped latch shafts 21 in alternative embodiments will provide a desirable feature of keying needed for some applications, such as when it is desirable to require that a particular latch be inserted only into matching receptacles or only at specific orientations to such receptacles.

In addition to the hexagonal shaped latch shaft 21 and latch projection guides 43, of the preferred embodiment, a secondary preferred embodiment consists of a cylindrical latch projection guide 43 (not shown). This embodiment allows the latch mechanism 20 to be securely fastened within hexagonal shaped latch receptacle 45, while allowing the latch mechanism 20 to rotate within its latch housing cavity 40 and within its latch projection guide 43. This rotation allows the orientation of the two interconnected toy construction balls to be modified without releasing the engaged latch mechanism. For the cylindrical latch projection guide 43 embodiment, the diameter of the latch projection guide 43 is selected to be slightly larger that the largest bisection of the corresponding hexagonal shaped latch engagement receptacles 45. It is envisioned that in the children's construction toy application of the current invention, a mixture of hexagonal and cylindrically shaped latch projection guides 43 would be utilized to allow the user to construct complex structures while controlling which sections of the structure are allowed to rotate.

While the preferred embodiment of the current invention uses a three pronged 30, hexagonal latch shaft 21 implementation, these characteristics are not critical to the effective operation of the invention. It is envisioned that alternative, non-hexagonal shapes would be used for various applications, and it is envisioned that some of those applications would be better served with two, or four or more prongs 30 per latch mechanism 20, rather than three.

While the preferred embodiment utilizes engagement flanges 24 at the tip of the latch prongs 30 and engagement receptacle flanges 46 to prevent retraction of the engaged latch mechanism 20 from the latch receptacle 45, alternative designs using tongue-and-groove techniques or other common interlocking techniques are anticipated. In a tongue-and-groove implementation (not shown), any number of tongues would encircling the latch shaft 21 outer surfaces such that they would mate with matching receptacle grooves located on the inner walls of the latch engagement receptacle 45 during latch engagement. The tongue-and-groove implementation is more suitable in applications where the latch retraction force imposed by the spring 54 is anticipated to be so excessive as to impart damaging stress to the engagement flanges 24 of the preferred embodiment.

The preferred embodiment of the current invention has no barrier between the pin release zone 62 and the float zone region 67. Without such a barrier, which could be provided by including a small ridge or cam between these areas, the locking pin 10 is free to rotated inadvertantly such that the locking pin fingers 11 enter the float zone region 67 during normal handling of disengaged toy construction balls. When this occurs, the locking pin is free to slide out of the locking pin cavity 26 slightly such that the locking pin outer head 13 protrudes slightly from the toy ball during handling. This is not envisioned to be problematic for the toy construction ball application of the current invention. For other embodiments, however, it may be desirable to include a slight ridge or cam between the pin release zone 62 and the float zone region 67. This would prevent locking pin 10 from rotating until a counter-clockwise rotational force is intentionally applied to the locking pin 10 by the locking tool (not shown in any figures). This counter-clockwise rotational force is described in the Operation of Invention section of this specification as the first step of the engagement process.

The preferred embodiment of the current invention relies upon a linear impact to the locking pin outer head 13 to knock the locking pin fingers 11 off of the prong expansion cams 31. It should be noted that the release of the latch mechanism 20 could also be triggered by application of a rotational force to the locking pin outer head 13. It is envisioned that other embodiments will rely upon this rotational force trigger means.

The preferred embodiment uses a plastic locking pin 10 with a solid plastic locking pin inner head 12. In the preferred embodiment, the resiliency of the latch prongs 30 allow the prongs 30 to expand considerably when the locking pin 10 is inserted into the locking pin cavity 26. In embodiments in which alternative less-resilient materials are desireable, alternative locking pin inner head 12 embodiments may be used. An alternative embodiment of the locking pin inner head 12 for such applications is to construct the locking pin inner head 12 using concentrically arranged flexible prongs (not shown) that can will flex inward slightly as the locking pin 10 is inserted into the locking pin cavity 26, but will return to an outer diameter that exceeds the inside diameter of the rotation barrier shoulders 36 once the inner pin head 12 fully enters the inner pin head cavity 27. An second alternative is to construct the set of locking pin fingers 11 such that they interact with the collar created by the interior surface of the locking pin shaft guide 37, thus relying on the pressure of the fingers 11 against the collar to push the latch against the spring bias, rather than relying on the pressure of the inner locking pin head 12 against the rotation barrier shoulder 36 to perform this function.

What I claim is:

1. A remotely-triggered quick-release fastener mechanism comprising:

a primary object including a latch housing, a projectable latch located within said latch housing, said projectable latch comprising a latch shaft, and a spring for urging said projectable latch towards a disengaged position within said latch housing;

a secondary object including a receptacle having an exterior side and an interior side, said latch shaft being constructed to be inserted into said exterior side of said receptacle towards said interior side of said receptacle thereby fastening said primary object to said secondary object;

an engagement means attached to said projectable latch for engaging said receptacle when said projectable latch of said primary object is inserted into said receptacle of said secondary object, said engagement means causing said projectable latch to interact with said receptacle such that said primary object becomes fastened to said secondary object when said projectable latch is inserted into said receptacle; and a trigger means connected to said primary object and located in the vicinity of the interior side of the receptacle when the primary object is fastened to the secondary object, said trigger means causing the automatic retraction of said latch shaft from said receptacle when said trigger means is physically manipulated;

whereby said primary object is constructed to be fastened to said secondary object via engagement of said engagement means and released from said secondary object via manipulation of said trigger means in the vicinity of the interior side of the receptacle, said spring causing the automatic retraction of said latch shaft from said receptacle when said primary object is released from said secondary object.

2. The fastener mechanism as defined in claim 1 wherein said latch shaft comprises at least one flexible prong, said prong being constructed to be expanded radially outward from the center axis of said shaft during latch engagement, whereby said engagement means is effected by flexing said prong radially outward to increase the effective cross-sectional area of said shaft.

3. The fastener mechanism as defined in claim 1 wherein said shaft portion of said latch is generally hexagonal in cross-sectional shape and said receptacle is similarly shaped.

4. The fastener mechanism as defined in claim 1 wherein said shaft has an irregular polygon cross-sectional shape and said receptacle has a similar shape, whereby said shaft is dimensioned and arranged to be inserted into said receptacle at predefined rotational orientations.

5. The fastener mechanism as defined in claim 1 wherein said latch comprises a tool slot for effecting said engagement means, whereby a tool is constructed to be inserted into said tool slot to apply a force for engagement of said latch.

6. The fastener mechanism as defined in claim 1 wherein said latch shaft comprises an inner cavity and a locking pin, said locking pin being located within said cavity, and said locking pin being moveable within said cavity, whereby said trigger means comprises movement of said locking pin relative to said cavity.

7. The fastener mechanism as defined in claim 6 wherein said cavity comprises at least one cam and said locking pin comprises at least one finger, whereby said engagement means comprises a physical interaction between said finger and said cam.

8. The fastener mechanism as defined in claim 6 wherein said locking pin comprises a trigger member, said trigger member being exposed for said trigger means within the interior side of said receptacle.

9. The fastener mechanism as defined in claim 2 wherein said latch shaft and said prong are dimensioned and arranged with a non-engaged cross-sectional area that is smaller than the cross-sectional area of said receptacle, whereby retraction of said shaft from said receptacle is generally frictionless.

10. The fastener mechanism as defined in claim 1 wherein said latch comprises a flange, said receptacle comprises a shoulder, and said engagement means comprises the positioning of said flange against said shoulder, whereby the fastening of said primary object to said secondary object is secured by more than just the friction between said latch shaft and said receptacle.

11. A cascading-release fastener mechanism comprising a housing cavity part of a primary object, said housing cavity comprising a trigger chamber area, a latch located within said housing cavity, said latch comprising a latch shaft, said latch shaft being projectable from said housing cavity, a spring means for urging said latch towards said trigger chamber area of said housing cavity, at least one receptacle part of said primary object, said receptacle comprising a hole extending from the exterior surface of said primary object into said trigger chamber area, said receptacle being constructed for interaction with a downstream latch shaft part of a downstream object allowing said downstream object to be fastened to said primary object, an engagement means for projecting said latch shaft part of said primary object from said housing cavity for insertion into an upstream receptacle part of an upstream object, said engagement means causing said latch part of said primary object to interact with said upstream receptacle such that said primary object becomes fastened to said upstream object, and a trigger means for releasing said latch from said upstream receptacle, said trigger means being actuated by physical manipulation of the end of said latch shaft part of said primary object that is projected into an upstream trigger chamber area of said upstream object, whereby said primary object is constructed to be fastened to said upstream object and a plurality of immediate downstream objects are constructed to be fastened to said primary object and a plurality of additional downstream objects are constructed to be similarly fastened to each of said immediate downstream objects, ad infinitum, to form a complex physical structure, and whereby said spring means retraction of an upstream latch part of said upstream object actuates said trigger means of said primary object allowing said spring means of said primary object to urge said latch part of said primary object to retract into said trigger chamber area of said primary object actuating a downstream trigger means of each said immediate downstream object, ad infinitum, generating a cascading release of said latch parts of said objects that form said complex physical structure.

12. The cascading-release fastener mechanism as defined in claim 11 wherein said latch shaft is comprised of at least one flexible prong, said prong being constructed to be expanded radially outward from the center axis of said shaft during latch engagement, whereby said engagement means is effected by flexing said prong radially outward to increase the effective cross-sectional area of said shaft.

13. The cascading-release fastener mechanism as defined in claim 11 wherein said latch shaft is generally hexagonal in cross-sectional shape and said receptacles are similarly shaped.

14. The cascading-release fastener mechanism as defined in claim 11 wherein said receptacle part of said primary object has an irregular polygon cross-sectional shape and said shaft portion of said latch part of at least one of said downstream objects is similarly shaped, whereby said downstream object is constructed to be fastened to said primary object at predefined rotational orientations.

15. The cascading-release fastener mechanism as defined in claim 11 wherein said latch comprises a tool slot for effecting said engagement means, whereby a tool is constructed to be inserted into said tool slot to apply a force for engagement of said latch.

16. The cascading-release fastener mechanism as defined in claim 11 wherein said latch comprises a cavity and a locking pin, said locking pin being located within said cavity, whereby said trigger means comprises movement of said locking pin relative to said cavity.

17. The cascading-release fastener mechanism as defined in claim 16 wherein said cavity comprises at least one cam and said locking pin comprises at least one finger, whereby said engagement means comprises a physical interaction between said finger and said cam.

18. The cascading-release fastener mechanism as defined in claim 16 wherein said locking pin comprises a trigger member, said trigger member being exposed within said upstream trigger chamber area of said upstream object when said primary object is fastened to said upstream object, whereby said trigger means is affected by physical manipulation of said trigger member within said upstream trigger chamber.

19. The cascading-release fastener mechanism as defined in claim 12 wherein said latch shaft and said prong are dimensioned and arranged with a non-engaged cross-sectional area that is smaller than the cross-sectional area of said receptacle, whereby retraction of said shaft from said receptacle is generally frictionless.

20. The cascading-release fastener mechanism as defined in claim 11 wherein said latch comprises a flange, said receptacle comprises a shoulder, and said engagement means comprises the positioning of said flange against said shoulder, whereby the fastening of said primary object to said upstream object is secured by more than just the friction between said latch and said upstream receptacle.

* * * * *